US005313716A

United States Patent [19]

Wolfe

[11] Patent Number: 5,313,716

[45] Date of Patent: May 24, 1994

[54] MULTI-POSITION HAIR DRYER

[76] Inventor: Sandra S. Wolfe, 3635 Vincent Rd., North Street, Mich. 48049

[21] Appl. No.: 10,065

[22] Filed: Jan. 27, 1993

[51] Int. Cl.[5] ..... F26B 19/00

[52] U.S. Cl. ..... 34/90; 34/96; 34/97

[58] Field of Search ..... 34/3, 90, 91, 96, 97, 34/98, 239; 248/118, 177

[56] References Cited

U.S. PATENT DOCUMENTS

| | | | |
|---|---|---|---|
| 1,637,488 | 8/1927 | Knopp | 34/90 |
| 2,051,730 | 8/1936 | McCandless | 34/90 |
| 2,298,426 | 10/1942 | Shinn et al. | 34/90 |
| 2,738,593 | 3/1956 | Fox | 34/90 |
| 2,747,296 | 5/1956 | Mitchell | 34/90 |
| 2,856,700 | 10/1958 | Wales | 34/97 |
| 4,295,283 | 10/1981 | Tomaro | 34/97 |
| 4,712,313 | 12/1987 | Gettleman | 34/97 |

*Primary Examiner*—Henry A. Bennet
*Assistant Examiner*—Denise Gromada
*Attorney, Agent, or Firm*—Harness, Dickey & Pierce

[57] ABSTRACT

There is provided a hair drying system which comprises a support means for an individual which causes the individual's hair to hang vertically, generally away from the individual's head. A hair drying means is positioned with respect to the hanging hair and directs room temperature or warmed air through the hair to effect drying. Fingers and/or ribs can be incorporated into the hair drying means to help separate the hair and better direct the air flow through the hair.

17 Claims, 2 Drawing Sheets

MULTI-POSITION HAIR DRYER

FIELD OF THE INVENTION

The present invention relates to an apparatus for drying hair. More particularly, the present invention relates to an apparatus for drying hair which causes the hair to hang in a generally vertical position while directing air flow up and through the hair to effect drying.

BACKGROUND OF THE INVENTION

The hair care industry currently uses a variety of hair drying apparatuses when it is necessary to dry and style an individual's hair. These hair drying apparatuses range from the large stand alone hood type of hair dryers to the portable hand held blow dryers.

The large stand alone hood type of hair dryers work effectively to dry and style an individuals hair while at the same time, they provide the freedom for the beautician to perform additional tasks. The problems associated with these type of hair dryers is the excessive amount of time it takes to dry and style the individual's hair. When using the hood type of hair dryers, the individual is normally sitting upright with their hair laying against the top and sides of their head. The hood type of hair dryers dry the individual's hair from the scalp to the ends of the hair. Depending on the length of the individual's hair, the desired style and the thickness of the individual's hair, the hood type of hair dryers must penetrate multiple layers of hair in order to completely dry and style the hair. The time required for this hair drying and styling can be as long as 45 minutes to an hour.

The portable hand held blow dryers have become popular in recent times. They are capable of blow drying an individual's hair in a substantially shorter period of time when compared to the hood type of hair dryers. The hand held blow dryers blow room temperature or heated air towards and through the wet hair of the individual. The blowing effect of this moving air has the tendency to separate the hair while the warm air aids in the evaporation of the water and thus the drying of the hair. This combination of separating the hair by blowing room temperature or warmed air into and through the hair significantly reduces the time necessary to dry the individual's hair. In addition, the blown air can be directed to specific areas of the individuals hair to effectively shorten the time required to dry the entire head of hair. The problem with these hand held portable blow dryers is that the individual or the beautician is required to manually operate the hair dryer and is therefore not provided the freedom to perform additional tasks.

Accordingly, what is needed is a hair drying system which is capable of drying the individual's hair in a limited amount of time while at the same time not requiring the personal attention of the individual or the beautician to operate the hair dryer and thus provide the necessary freedom for the beautician to perform additional tasks.

SUMMARY OF THE INVENTION

The present invention provides the art with a hair drying system which can dry an individual's hair in a limited amount of time while at the same time, operating automatically in order to provide the individual or the beautician with the freedom to perform additional tasks. The present invention comprises a support means for the individual which causes the individual's hair to hang vertically, generally away from the individual's head. A hair drying means is positioned below the hanging hair and directs room temperature or warmed air in an upward direction up and through the hair to effect drying. Fingers and/or ribs can be incorporated into the hair drying means to help separate the hair and better direct the air flow up and through the hair.

From the subsequent detailed description, appended claims and drawings, other objects and advantages of the present invention will become apparent to those skilled in the art.

DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
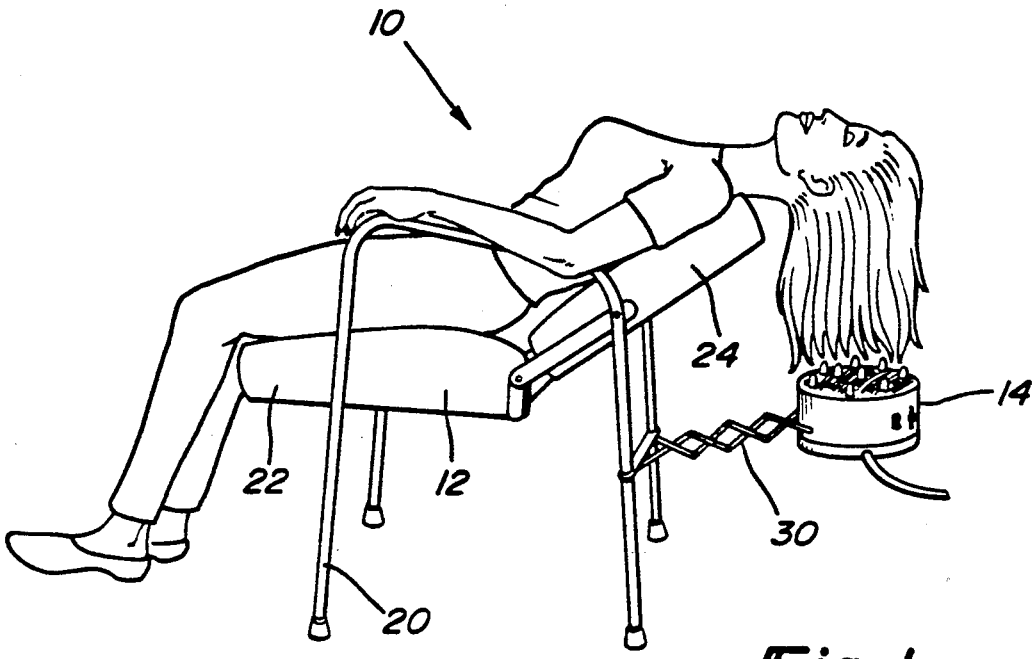
FIG. 1 is a longitudinal side view of the apparatus of the present invention extending from a chair.

Referring now to the drawings in which like reference numerals designate like or corresponding parts through the several views, there is shown in FIGS. 1 through 5 a hair drying apparatus 10 in accordance with the present invention. Apparatus 10 comprises a support means 12 for allowing the individual's hair to hang vertically, generally away from the individual's head, and hair drying means 14 which directs and blows the room temperature or warmed air up and through the individual's hair.

Support means 12 comprises a chair 20 having a seat 22 with a reclining back 24. The height of seat 22 can be made adjustable in order to accommodate various sizes of individuals and hair styles. In addition, reclining back 24 can be made to incline at various angles to accommodate the various sizes of individuals and different hair styles. Seat 22 and reclining back 24 are properly adjusted to insure that the individual's hair will hang vertically, extending generally away from the individual's head.

Figure 2:
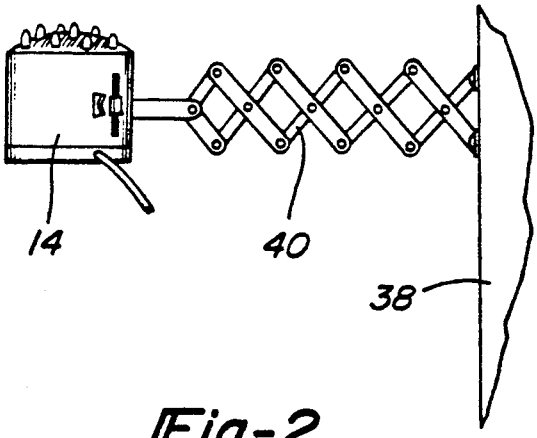
FIG. 2 is a longitudinal side view of the apparatus of the present invention extending from a wall.
Figure 3:
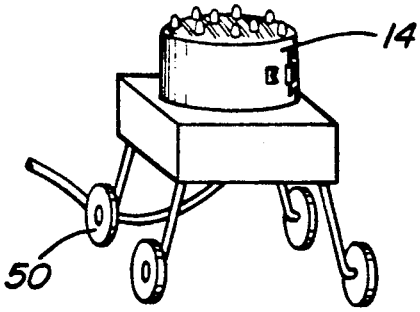
FIG. 3 is a longitudinal view of the apparatus of the present invention equipped with rollers for portability.

Referring now to FIGS. 1 through 3, various methods of interfacing hair drying means 14 with support means 12 are shown. FIG. 1 shows hair drying means 14 connected to support means 12 such that hair drying means 14 is adjustable in a horizontal direction. Hair drying means 14 is supported by a scissors type mechanism 30 to provide horizontal adjustment of hair drying means 14. The connection of scissors type mechanism 30 to both support 12 and hair drying means 14 can be rotatable to provide for additional horizontal adjustment if desired. The horizontal adjustment of hair drying means 14 in conjunction with the adjustment of support means 12 is used to accommodate the various individuals and hair styles.

FIG. 2 shows hair drying means 14 connected to a wall 38 or other structure which is separate from and spaced away from support means 12. Hair drying means 14 is supported by a scissors type mechanism 40 similar to that shown in FIG. 1 to again provide horizontal adjusted of hair drying means 14. The horizontal adjustment, similar to that of FIG. 1, in conjunction with the adjustment of support means 12 is again used to accommodate the various individuals and hair styles. The connection of scissors type mechanism 40 to wall 38 can also be rotatable to provide for additional horizontal adjustment if desired. The attachment of hair dryer means 14 to the scissors type mechanisms 30 and 40 shown in FIGS. 1 and 2, respectively, can also include a universal type of connector (not shown) such that hair drying means 14 may be located at any position relative to the individual's hair. This would include over, under or to either side. The universal type of mounting is well known in the art and allows the beautician to direct hair drying means 14 to specific portions of the individual's hair and still be left free to perform additional services or duties.

FIG. 3 shows hair drying means 14 movable around the floor on a plurality of rollers 50. In addition to the horizontal movement provided by rollers 50, hair drying means 14 can be provided with vertical adjustment. Again, these adjustments of hair drying means 14 in conjunction with the adjustment of support means 12 are used to accommodate the various individuals and hair styles. While hair drying means 14 is shown being movable on rollers 50, it is well within the scope of the present invention to provide hair drying means 14 with legs not having wheels, legs with suction cups or other various methods of supporting hair drying means 14 known well in the art.

Figure 4:
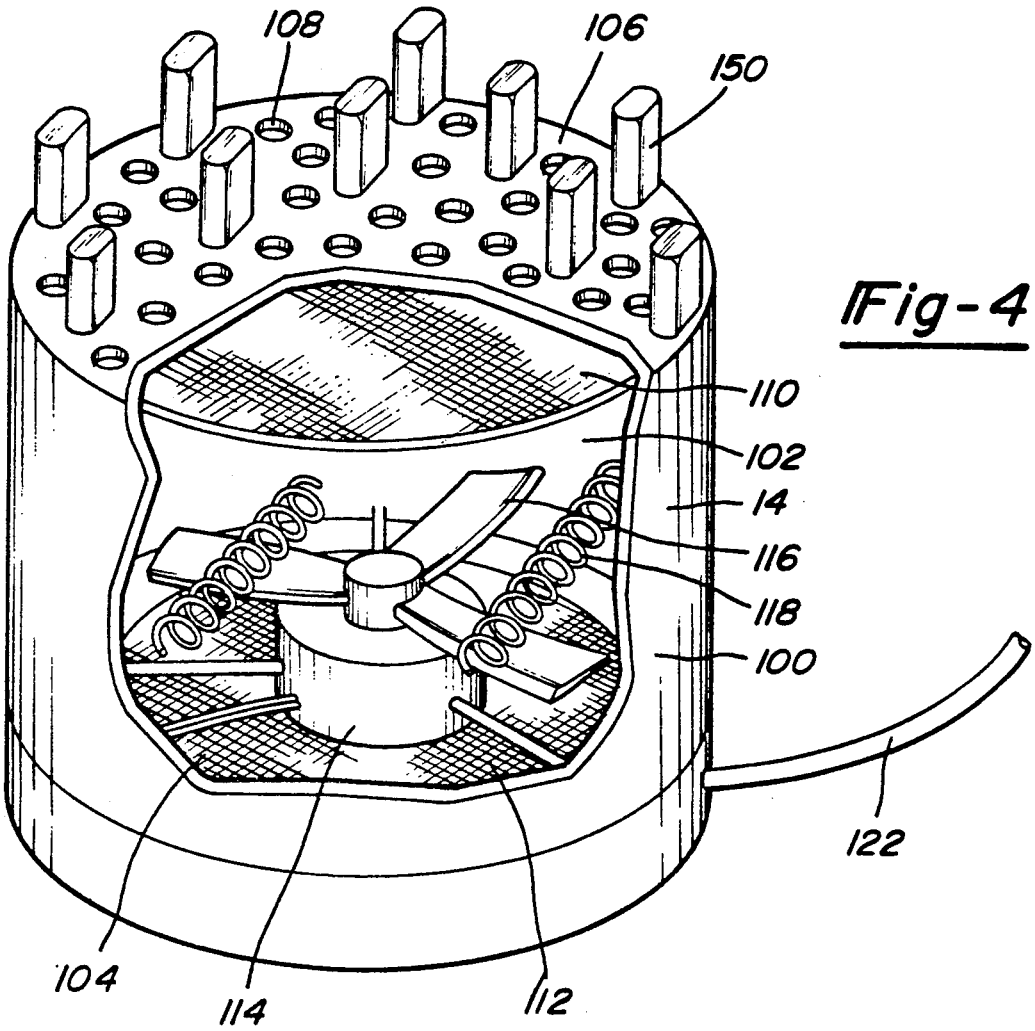
FIG. 4 is a perspective view, partially in cross section, of the hair drying means of the present invention.
Figure 6:
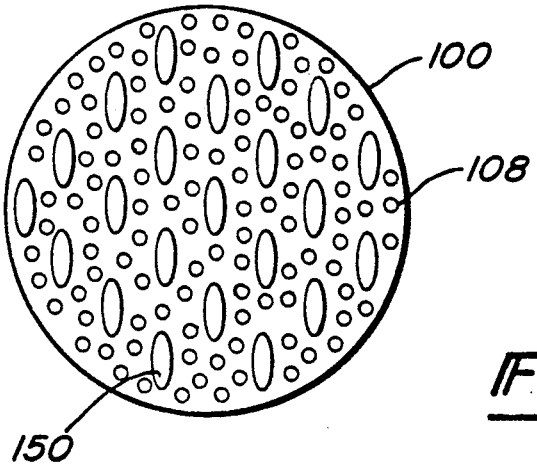
FIG. 6 is a top view of the hair drying means of the present invention.

FIG. 4 shows hair drying means 14 of the present invention. Hair drying means 14 comprises a generally hollow cylindrical shaped housing 100 defining an interior chamber 102. Internal chamber 102 has a circular opening 104 on the bottom side and a domed cover 106 on the top side. Domed cover 106 is provided with a plurality of holes 108 to allow for the flow of air through hair drying means 14. A screen 110 is provided on the lower side of domed cover 106 to prohibit the individual's hair from contacting the operating mechanism of hair drying means 14. Likewise, a screen 112 is provided across the opening 104 to again prohibit an individual's hair from contacting the operating mechanism.

Disposed within internal chamber 102 is an electric motor 114 driving a fan 116 having a plurality of blades (3 in FIG. 4). Fan 116 is operable to move air from the outside of hair drying means 14, upward through opening 104 and through the plurality of holes 108 to facilitate drying of the individual's hair. An electric heating coil 118 may also be placed within internal chamber 102 to heat the air as it travels through chamber 102 driven by fan 116. Electric heating coil 118 is controlled by a multi-position switch 120 which provides for various amounts of heat generated by coil 118. An electrical cord 122 adapted to be received in a standard wall plug (not shown) provides the necessary power to hair drying means 14. Cord 122 can be provided with a retractable mechanism 124 to simplify storage of the device when not in use if desired.

A plurality of fingers 150 extend upwardly from the domed cover 106 of housing 100 as shown in FIG. 4. Fingers 150 can be identical in length, random in length or alternately long and short. Fingers 150 help to separate the individual's hair to allow for better air flow up and through the individual's hair to improve drying. While fingers 150 are shown as being solid in FIG. 4, it is within the scope of the present invention to have fingers 150 hollow and in communication with chamber 102. An additional plurality of openings could then be provided through the walls of fingers 150 to provide even further distribution of blown room temperature or warmed air.

Figure 5:
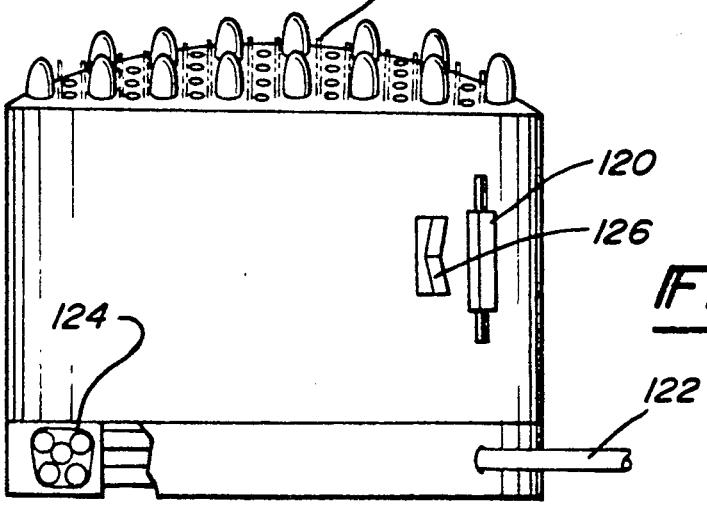
FIG. 5 is a side view of the hair drying means of the present invention.

Domed cover 106 of housing 100 can also be provided with a plurality of ribs 160 shown in phantom in FIGS. 5. Ribs 160 would also assist in the separation of the individual's hair to insure a more complete distribution of the blown room temperature or warmed air.

The operation of apparatus 10 is identical for each embodiment described above. An individual is positioned on support means 12. Seat 22 is adjusted vertically and reclining back 24 is adjusted angularly in conjunction with the horizontal and vertical movement of hair drying means 14. The individual and hair drying means 14 are positioned such that the individual's hair hangs vertically extending generally away from the individual's head interfacing with hair drying means 14. Power is then supplied to hair drying means 14 through switch 126 to direct air flow through housing 100 and upward through the individual's hair. The separation of the individual's hair in conjunction with the upward flow of air from hair drying means 14 will significantly lower the amount of time necessary to dry the individual's hair while providing the necessary freedom for the individual or the beautician to perform additional tasks. In addition, the quicker and more complete drying of the individual's hair will allow more style ability and provide more curl to the hair especially in the area of hair closer to the scalp.

While the above detailed description describes the preferred embodiment of the present invention, it should be understood that the present invention is susceptible to modification, variation and alteration without deviating from the scope and fair meaning of the subjoined claims.

What is claimed is:

1. An apparatus for drying hair, said apparatus comprising:

means for supporting an individual such that the hair of said individual hangs vertically, extending generally away from the head of said individual;

means for drying said hair, said drying means disposed below the head of said individual and operable to direct air flow upward through said hair; and means for positioning said drying means, said positioning means operable to locate said drying means below the head of said individual.

2. The apparatus of claim 1 further comprising means for heating the air prior to the air being directed through said hair.

3. The apparatus of claim 1 wherein said supporting means is a chair.

4. The apparatus of claim 3 wherein said chair is adjustable in a vertical direction.

5. The apparatus of claim 3 wherein said chair is adjustable in a reclining direction.

6. The apparatus of claim 1 wherein said drying means comprises an air blower disposed within a drying head.

7. The apparatus of claim 6 further comprising means for heating the air prior to the air being directed through said hair.

8. The apparatus of claim 6 wherein said drying head comprises:

a hollow cylindrical housing having an upper wall and defining a first interior chamber, said upper wall defining a first plurality of openings extending through said upper wall, said air blower being disposed within said first chamber such that air blown by said air blower enters said first chamber and subsequently exits said first chamber through said first plurality of openings; and a plurality of fingers extending upward from said upper wall of said cylindrical housing.

9. The apparatus of claim 8 wherein at least one of said plurality of fingers is hollow and defines a second internal chamber in communication with said first chamber, said at least one of said plurality of fingers having a second plurality of openings such that air blown by said air blower enters said first chamber then enters said second chamber and subsequently exits said second chamber through said second plurality of openings.

10. The apparatus of claim 8 wherein said upper wall has a plurality of ribs extending from a surface of said upper wall opposite to said interior chamber.

11. The apparatus of claim 1 wherein said positioning means comprises a scissors mechanism having a first end and a second end, said first end of said scissors mechanism rotatably attached to said drying means.

12. The apparatus of claim 11 wherein said second end of said scissors mechanism is rotatably attached to said supporting means.

13. The apparatus of claim 11 wherein said second end of said scissors mechanism is adapted to be rotatably attached to a wall.

14. The apparatus of claim 1 wherein said positioning means is a plurality of legs.

15. The apparatus of claim 1 wherein at least one of said plurality of legs is provided with a wheel.

16. An apparatus for drying hair, said apparatus comprising:

a chair being adjustable in both a vertical and reclining direction, said chair operable to support an individual such that the hair of said individual hangs vertically, extending generally away from the head of said individual;

an air blower having means for heating the air;

a drying head having an internal chamber and a plurality of openings through an upper wall, said air blower being disposed within said internal chamber such that the air blown by said air blower enters said internal chamber and subsequently exits said internal chamber through said plurality of openings;

a plurality of fingers extending upward from said upper wall of said drying head; and means for positioning said drying head, said positioning means operable to locate said drying means directly below the head of said individual.

17. The apparatus of claim 16 wherein said upper wall has a plurality of ribs extending from a surface of said upper wall opposite to said interior chamber.

* * * * *